US008645070B2

(12) United States Patent
Hanson et al.

(10) Patent No.: US 8,645,070 B2
(45) Date of Patent: Feb. 4, 2014

(54) SYSTEM AND METHOD FOR ESTIMATING FLUID DISTRIBUTION IN A SUBTERRANEAN RESERVOIR

(75) Inventors: Scott Hanson, Cypress, TX (US); Jeroen Brantjes, Perth (AU); Katherine Trigg, Perth (AU)

(73) Assignee: Chevron U.S.A. Inc., San Ramon, CA (US)

( * ) Notice: Subject to any disclaimer, the term of this patent is extended or adjusted under 35 U.S.C. 154(b) by 583 days.

(21) Appl. No.: 12/954,374

(22) Filed: Nov. 24, 2010

(65) Prior Publication Data

US 2012/0130639 A1 May 24, 2012

(51) Int. Cl.
*G01V 1/40* (2006.01)
*G01V 9/02* (2006.01)

(52) U.S. Cl.
USPC ..... 702/12; 324/303

(58) Field of Classification Search
USPC ..... 702/6, 11–13, 138; 73/38; 324/303; 703/10
See application file for complete search history.

(56) References Cited

U.S. PATENT DOCUMENTS

| | | | | |
|---|---|---|---|---|
| 4,926,128 | A | 5/1990 | Givens | |
| 6,484,102 | B1 * | 11/2002 | Holmes | 702/6 |
| 6,833,699 | B2 | 12/2004 | Galford et al. | |
| 7,277,795 | B2 | 10/2007 | Boitnott | |
| 7,567,079 | B2 * | 7/2009 | Chen et al. | 324/303 |
| 2009/0248309 | A1 | 10/2009 | Neville | |
| 2010/0198638 | A1 | 8/2010 | Deffenbaugh et al. | |
| 2010/0277167 | A1 | 11/2010 | Romero | |

FOREIGN PATENT DOCUMENTS

WO 2009/138934 11/2009

OTHER PUBLICATIONS

Vizcarra, Edwin et al., "Challenges of Saturation Height Modeling in a Low Resistivity, Complex Carbonate Porosity System: The Impact of Microporosity in the Uwainat Member, Bul Hanine Field, Offshore Qatar," International Petroleum Technology Conference, IPTC 13578, pp. 1-19, 2009.

PCT/US2011/051908, International Search Report and Written Opinion, filed Sep. 16, 2011, 4 pages.

* cited by examiner

*Primary Examiner* — Manuel L Barbee
(74) *Attorney, Agent, or Firm* — Carlos Hanze; Albert Shung

(57) ABSTRACT

A system and method for determining fluid distribution in subterranean reservoirs including determining a water saturation in macroporosity from the capillary pressure data representative of the macroporosity using a saturation height function, correcting capillary pressure data representative of microporosity to have an entry pore value equivalent to a pore size defining the microporosity, determining a water saturation in the microporosity from the corrected capillary pressure data representative of the microporosity, and using the macroporosity water saturation and the microporosity water saturation to estimate fluid distribution within the subterranean reservoir. The system and method may also include the estimation of hydrocarbon reserves.

21 Claims, 4 Drawing Sheets

SYSTEM AND METHOD FOR ESTIMATING FLUID DISTRIBUTION IN A SUBTERRANEAN RESERVOIR

FIELD OF THE INVENTION

The present invention relates generally to methods and systems for estimating fluid distribution in a subterranean reservoir, and in particular methods and systems for calculating water saturation within the macroporosity and microporosity of the rock formations to estimate fluid distribution in a subterranean reservoir.

BACKGROUND OF THE INVENTION

Calculating fluid distribution in subterranean reservoirs is an important step in determining potential hydrocarbon reserves. As hydrocarbon exploration and production moves to unconventional reservoirs such as complex carbonate formations and shale gas formations, the calculation of the fluid distribution becomes more difficult because of the varying porosity of the rocks in the formation. In particular, microporosity within the formation may cause fluid distribution calculations to be inaccurate.

In gas reservoirs, microporosity will hold most of the water in the formation and most of the water will not flow out of the microporosity, however some gas could be produced and included in the Gas In Place values so as to not underestimate reserves. In oil reservoirs, if a significant amount of oil is held in microporosity, then alternate recovery techniques, such as horizontal drilling and hydraulic fracturing, could be designed to better recover the oil.

Existing methods for calculating fluid distribution in subterranean reservoirs do not take into account the differences between the fluids in macropores and the fluids in micropores. These existing methods may use an average porosity that combines the microporosity and macroporosity or simply ignore the microporosity. When the reservoir under consideration has significant microporosity, such as oil shale reservoirs and shale gas reservoirs, the existing methods may not accurately calculate the fluid distribution.

SUMMARY OF THE INVENTION

Described herein are implementations of various approaches for determining fluid distribution in subterranean reservoirs and, more particularly, for using water saturation in macroporosity and water saturation in microporosity to determine fluid distribution in subterranean reservoirs. According to one aspect of the present invention, a computer-implemented method for estimating fluid distribution in subterranean reservoirs may include receiving capillary pressure data from at least one representative rock sample, then setting a threshold dividing the capillary pressure data representative of microporosity and the capillary pressure data representative of macroporosity. The water saturation in the macroporosity may be determined from the capillary pressure data related to the macroporosity using a saturation height function. The capillary pressure data related to the microporosity may be corrected to have an entry pore value equivalent to the pore size defining the microporosity and the corrected data may be used to determine the water saturation in the microporosity using a saturation height function. The macroporosity water saturation and the microporosity water saturation may then be used to estimate fluid distribution within the subterranean reservoir. The fluid distribution in the reservoir may also be used to estimate hydrocarbon reserves.

The present invention may also be practiced as a system including a data source containing capillary pressure data that is input to at least one computer processor configured to execute computer program modules. The computer program modules may include an input module to receive the capillary pressure data, a thresholding module to set a threshold between the capillary pressure data representative of microporosity and the capillary pressure data representative of macroporosity, a correction module to correct or normalize the entry pore value of the capillary pressure data representative of microporosity to a pore throat size defining microporosity, a water saturation module to calculate the water saturation in the microporosity and macroporosity, and a fluid distribution module to estimate the fluid distribution in a subterranean reservoir. The computer program modules may also include a a hydrocarbon reserves module to calculate hydrocarbon reserves and an output module to store or display fluid distribution, hydrocarbon reserves, water saturations, or corrected capillary data. The system may also include a user interface to allow interaction with the computer program modules and/or observe results of the computer program modules.

In addition, the present invention encompasses an article of manufacture including a computer readable medium having computer readable code on it, which will allow a computer to implement a method for estimating fluid distribution in a subterranean reservoir. The method may include determining the macroporosity water saturation from capillary pressure data representative of the macroporosity, correcting the entry pore value of the capillary pressure data representative of microporosity to a pore throat size defining microporosity, using the corrected data to determine the water saturation in the microporosity, and using the macroporosity water saturation and microporosity water saturation to calculate the fluid distribution in the subterranean reservoir. The method may also include setting a threshold to separate the capillary pressure data representative of macroporosity from the capillary pressure data representative of microporosity and estimating hydro carbon reserves.

The above summary section is provided to introduce a selection of concepts in a simplified form that are further described below in the detailed description section. The summary is not intended to identify key features or essential features of the claimed subject matter, nor is it intended to be used to limit the scope of the claimed subject matter. Furthermore, the claimed subject matter is not limited to implementations that solve any or all disadvantages noted in any part of this disclosure.

BRIEF DESCRIPTION OF THE DRAWINGS

These and other features of the present invention will become better understood with regard to the following description, claims and accompanying drawings where:

DETAILED DESCRIPTION OF THE INVENTION

Figure 1:
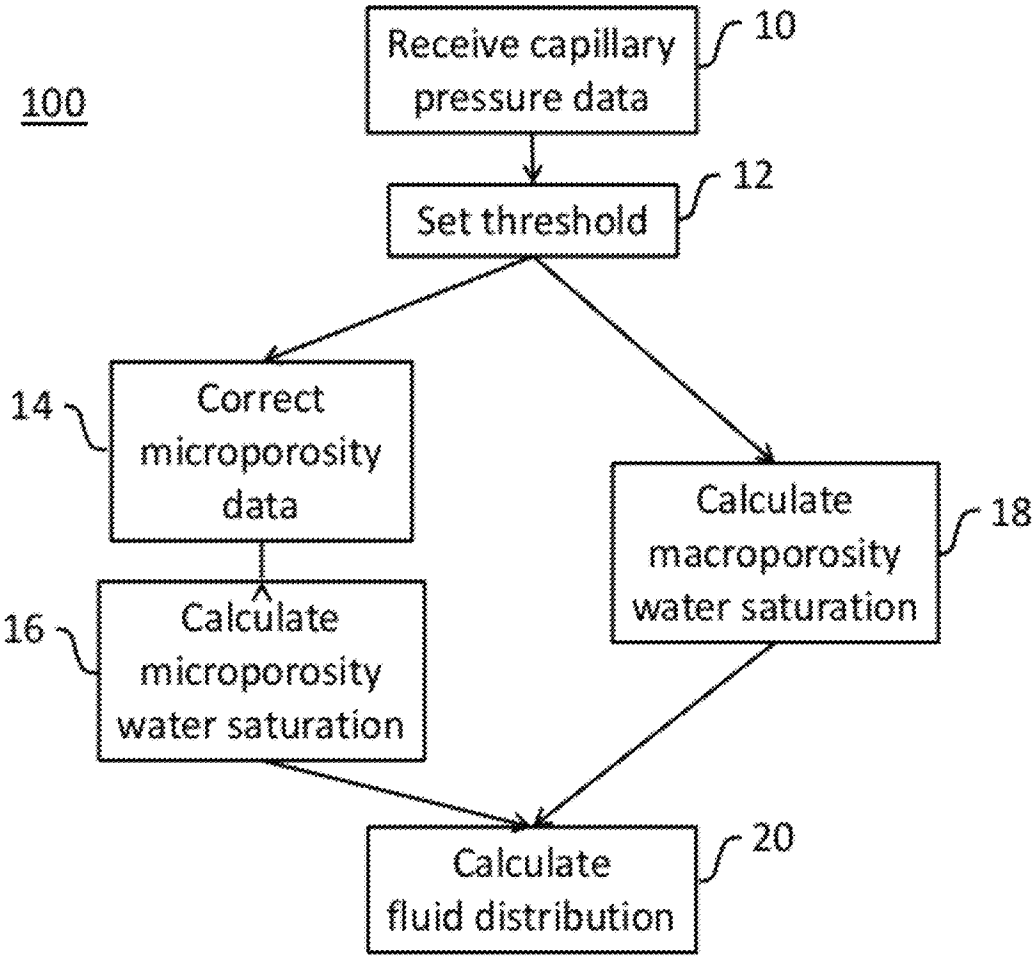
FIG. 1 is a flowchart illustrating a method in accordance with an embodiment of the invention.

The present invention may be described and implemented in the general context of a system and computer methods to be executed by a computer. Such computer-executable instructions may include programs, routines, objects, components, data structures, and computer software technologies that can be used to perform particular tasks and process abstract data types. Software implementations of the present invention may be coded in different languages for application in a variety of computing platforms and environments. It will be appreciated that the scope and underlying principles of the present invention are not limited to any particular computer software technology.

Moreover, those skilled in the art will appreciate that the present invention may be practiced using any one or combination of hardware and software configurations, including but not limited to a system having single and/or multiple processor computers, hand-held devices, programmable consumer electronics, mini-computers, mainframe computers, and the like. The invention may also be practiced in distributed computing environments where tasks are performed by servers or other processing devices that are linked through a one or more data communications network. In a distributed computing environment, program modules may be located in both local and remote computer storage media including memory storage devices. The present invention may also be practiced as part of a down-hole sensor or measuring device or as part of a laboratory measuring device.

Also, an article of manufacture for use with a computer processor, such as a CD, pre-recorded disk or other equivalent devices, may include a computer program storage medium and program means recorded thereon for directing the computer processor to facilitate the implementation and practice of the present invention. Such devices and articles of manufacture also fall within the spirit and scope of the present invention.

Referring now to the drawings, embodiments of the present invention will be described. The invention can be implemented in numerous ways, including for example as a system (including a computer processing system), a method (including a computer implemented method), an apparatus, a computer readable medium, a computer program product, a graphical user interface, a web portal, or a data structure tangibly fixed in a computer readable memory. Several embodiments of the present invention are discussed below. The appended drawings illustrate only typical embodiments of the present invention and therefore are not to be considered limiting of its scope and breadth.

The present invention relates to determining fluid distribution in subterranean reservoirs by calculating and combining water saturation in macroporosity and microporosity within the reservoir. The inventor has found that by determining water saturation for macroporosity and microporosity separately, fluid distribution within the subterranean reservoir may be accurately modeled. The macroporosity and microporosity in the reservoir can be determined by analyzing capillary pressure data from representative rock samples and the water saturation for each can be calculated using a saturation height function. The capillary pressure data related to the microporosity may be corrected prior to calculating the water saturation.

In this regard, an example of a method 100 in accordance with the present invention is illustrated in the flowchart of FIG. 1. At step 10, capillary pressure data is received. As will be appreciated, the capillary pressure data may be acquired by any of a variety of laboratory methods including Mercury Capillary Pressure Injection (MICP) and the air-brine centrifuge method.

The capillary pressure data ($P_c$) can be related to the pore throat radius (r), with the following equation:

$$r = \frac{2 * \sigma * \cos\theta}{P_c} \quad \text{Eqn. 1}$$

where σ is the interfacial tension in units of dynes/cm, θ is the contact angle of the fluids in the rock, and C is a constant determined for the rock type and is approximately 1. From this equation, it is clear that the large pore throats that may be considered macroporosity in the rock are related to low pressure measurements and, conversely, high pressure measurements will be related to small pore throats or microporosity. Microporosity may be defined as having pore throat radii of less than 1 μm, typically less than 0.75 μm, and often less than 0.5 μm. Macroporosity often has pore throat radii greater than 0.5 μm but may have pore throat radii as small as 0.1 μm.

From the capillary pressure data, a pressure or pore throat size threshold between the macroporosity and microporosity can be set in step 12. In one embodiment, it is set based on a known threshold of pore throat size or capillary pressure. It may also be based on a graph of the capillary pressure data. The distribution of macroporosity and microporosity is observed based on graphing the pore throat size on the x axis and the cumulative porosity from core plugs on the y axis. Microporosity is determined by the lower bimodal distribution and the macroporosity is determined by the higher bimodal distribution.

Figure 2:
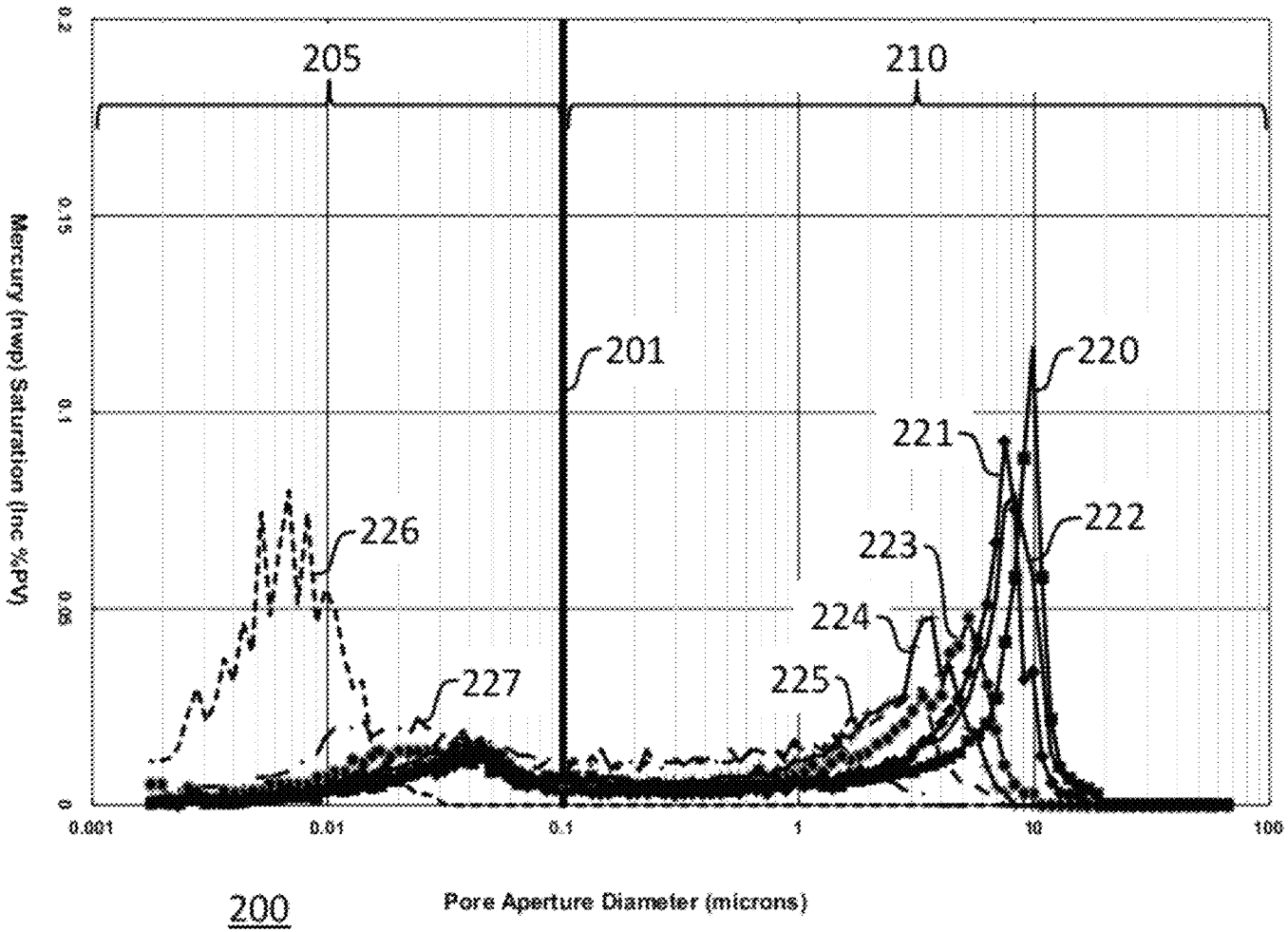
FIG. 2 is a graph of capillary pressure data.

FIG. 2 shows a graph of capillary pressure data 200 that is being displayed in terms of the pore throat diameter versus the mercury saturation with the threshold 201 separating the microporosity 205 and the macroporosity 210. There are eight curves, 220-227, representing capillary pressure data from eight representative rock samples. The capillary pressure data that is above the pressure threshold or below the pore throat size threshold is related to the microporosity. The present invention processes the capillary pressure data related to the microporosity differently from the capillary pressure data related to the macroporosity. Referring again to FIG. 1, at step 14 the capillary pressure data related to the microporosity is corrected, or normalized, to reflect that the entry pore value is equivalent to the pore throat size defining the microporosity, which means that the corrected data will reflect that the water saturation in the microporosity is 100% at the pressure or pore throat size threshold. This is done by subtracting the water saturation in the macroporosity and resetting the water saturation in the microporosity back to 100% as indicated in the following equation:

$$S_W = (1.0 - S_{Wmic_{co}}) + S_{Wmic} \quad \text{Eqn. 2}$$

where $S_{Wmic}$ is the saturation above the microporosity cut off and $S_{Wmic_{co}}$ is the saturation at the microporosity cut off.

After the capillary pressure data related to the microporosity is corrected, the water saturation of the microporosity may be calculated at step 16. In one embodiment, this calculation may be done using a saturation height function such as a Leverett J-function (J) as shown here:

$$J = \frac{0.2166 * P_c}{\sigma * \cos\theta} * \sqrt{\frac{K}{\varphi}} \quad \text{Eqn. 3}$$

where $P_c$ is the capillary pressure measurement in units of pounds per square inch (psi), σ is the interfacial tension in units of dynes/cm, K is the permeability and ϕ is the porosity of the rock Porosity may be obtained from log data. To determine permeability, one method that may be used is to obtain the permeability core data from MICP data, helium or air injection data of the core plugs, then plot the log porosity data against the core permeability data. This provides a line from which an equation may be derived. That equation is then used to create permeability data for the entire depth where porosity data is known.

The J-function is a dimensionless value for a rock-fluid system that accounts for the effects of fluid and pore geometry. Once the J-function is calculated, a relationship between J and $S_w$ must be determined. This may be done, for example, using linear regression analysis of $\log_{10}(S_w)$ and $\log_{10}(J)$ from air-brine capillary pressure data or from MICP data that has been corrected to simulate data from an air-brine system. After a regression line is established, a slope (b) and intercept (a) is noted from cross-plot data as input into a $S_w(J)$ function as:

$$\log_{10}S_W(J)=b*\log_{10}(J)+a \qquad \text{Eqn. 4}$$

Figure 3:
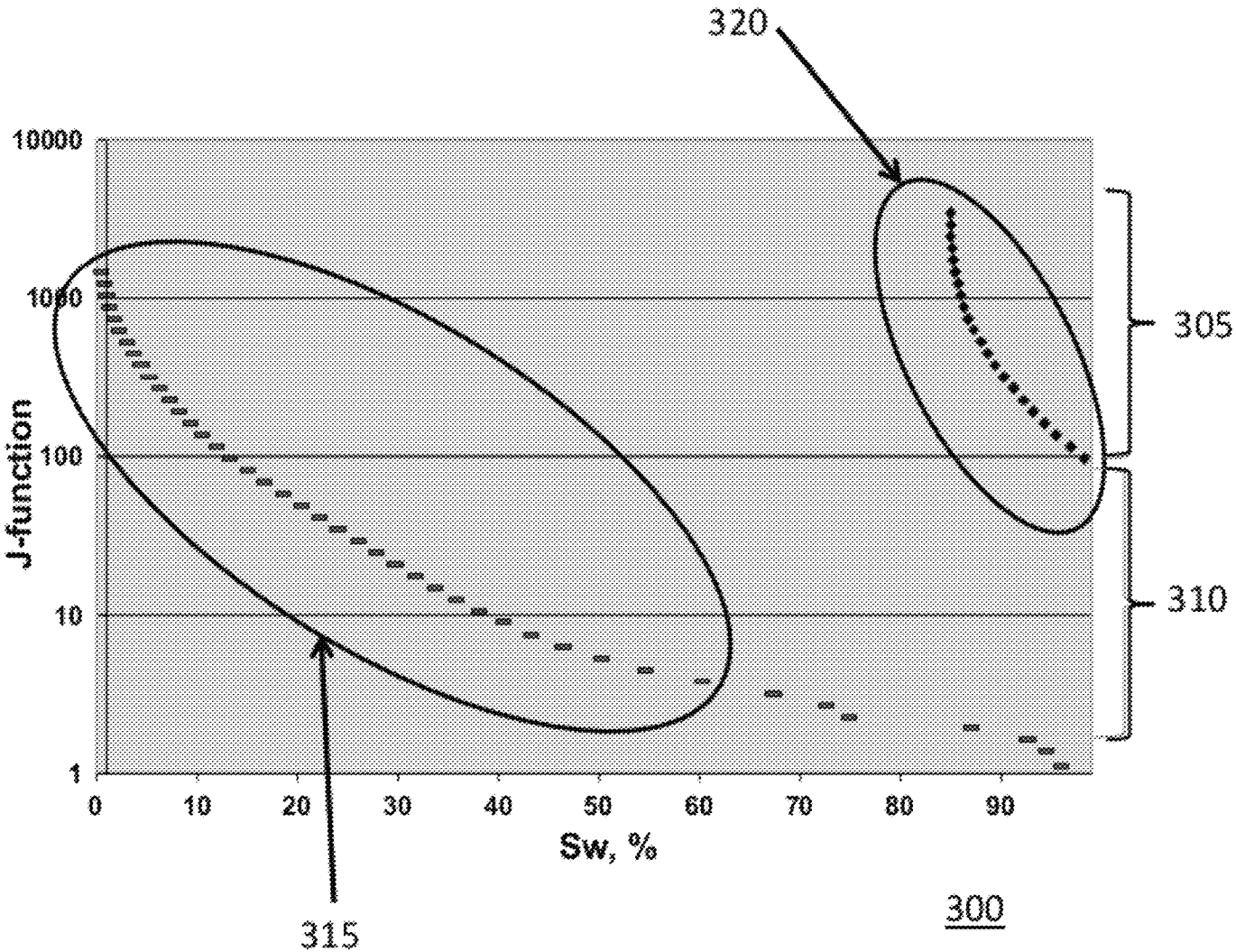
FIG. 3 is a graph of a saturation height function with microporosity data displayed before and after correction.

The capillary pressure data below the capillary pressure threshold or above the pore throat size threshold determined in step 12 is related to the macroporosity and can be used directly to calculate the water saturation in the macroporosity in step 18. In one embodiment, this calculation may also be done using a saturation height function such as a Leverett J-function as shown in Equation 3 and Equation 4. FIG. 3 shows a water saturation vs. J function graph 300 with regions of microporosity 305 and macroporosity 310 indicated. The data displayed includes the data related to the macroporosity and the data related to the microporosity without the correction 315 in step 14 and the data related to the microporosity after the correction 320 done in step 14. It will be appreciated that step 14 and step 16 are usually done in the order they are shown and step 18 may be done before, after, or concurrently with steps 14 and 16.

Referring again to FIG. 1, at step 20 the water saturation in the macroporosity and the water saturation in the microporosity are combined to calculate the fluid distribution in the reservoir. For this step, a map of the macroporosity and microporosity of the reservoir is needed. The macroporosity and microporosity can be determined, for example, from MICP measurements and then mapped throughout the reservoir during formation evaluation and subsurface modeling. One technique of populating a reservoir model with macroporosity and microporosity would be to use the relationship between acoustic impedance and each porosity component. Acoustic impedance may be available throughout the reservoir based on seismic data. The water saturation of the macroporosity and microporosity are then added to the subsurface model and are used to make the fluid distribution model. Once a fluid distribution model is established, hydrocarbon reserves can be estimated. For example, a one acre foot contains 7,758 barrels of oil. If the porosity is 30%, then the acre foot contains 30% of that. If the porosity is 30% and the water saturation is 50%, it means that half of the porosity is filled up with water, so there is 15% of available porosity for oil. Using macro- and microporosity and water saturation for each of those porosity components, it would be possible to further determine hydrocarbon distribution within a reservoir.

Figure 4:
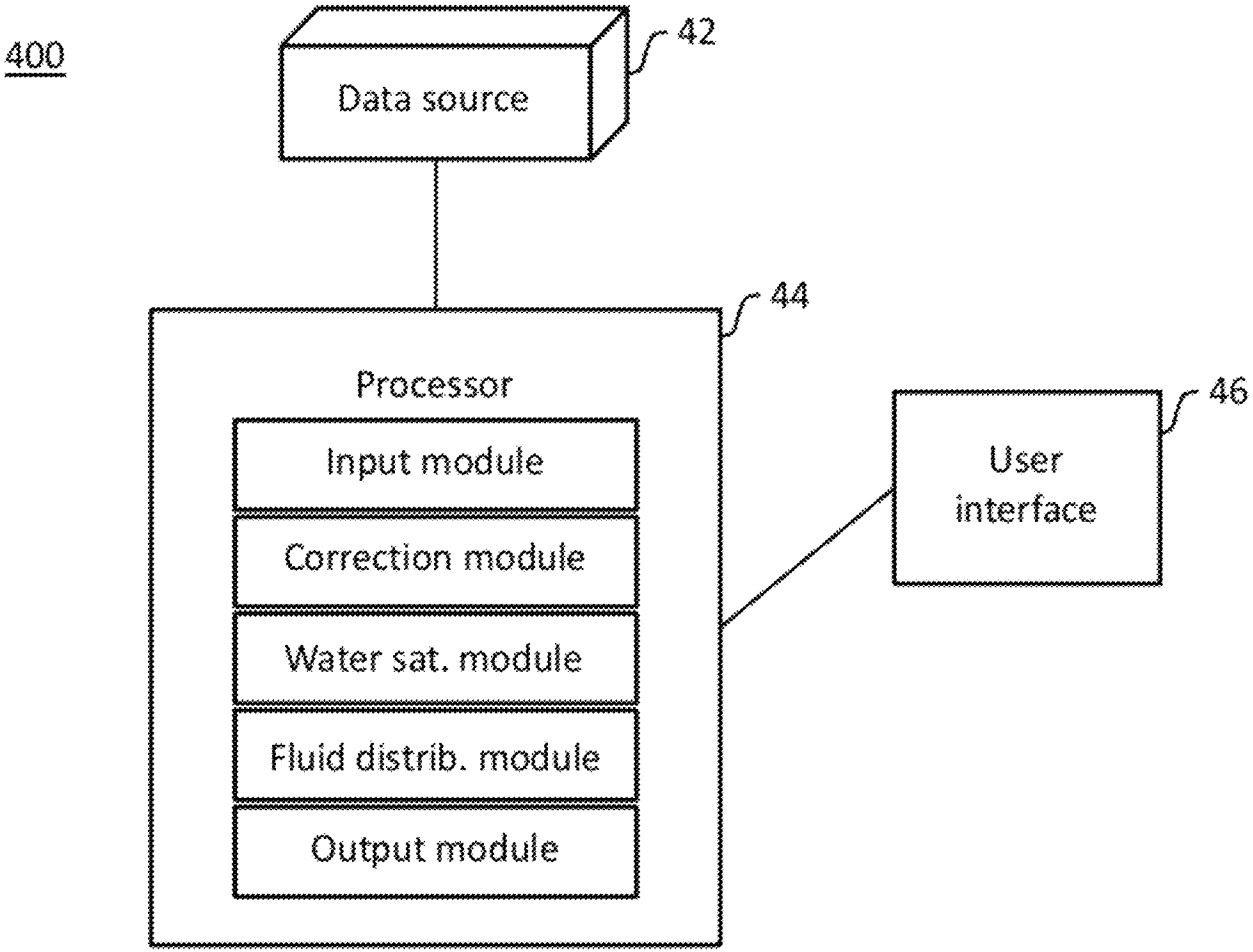
FIG. 4 schematically illustrates a system for performing a method in accordance with an embodiment of the invention.

A system 400 for performing the method is schematically illustrated in FIG. 4. The system includes a data source 42 which may include, among others, a data storage device or memory. The stored capillary pressure data may be made available to a processor 44, such as a programmable general purpose computer. The processor 44 is configured to execute a correction module to correct the capillary pressure data corresponding to the microporosity; a water saturation module to calculate a water saturation for the macroporosity and microporosity; a fluid distribution module to estimate the fluid distribution in the subterranean reservoir; and an output module to store or display at least one of the following: corrected capillary pressure data, the water saturation of the microporosity, the water saturation of the macroporosity, and/or the fluid distribution. The processor 44 may include interface components such as user interface 46, and is used to implement the above-described transforms in accordance with embodiments of the invention. The user interface 46 may be used both to display data and processed data products and to allow the user to select among options for implementing aspects of the method. The water saturations and fluid distribution computed on the processor 44 may be displayed on the user interface 46, stored on the data storage device or memory 42, or both displayed and stored. The fluid distribution estimated here may be further used to calculate hydrocarbon reserves.

While in the foregoing specification this invention has been described in relation to certain preferred embodiments thereof, and many details have been set forth for purpose of illustration, it will be apparent to those skilled in the art that the invention is susceptible to alteration and that certain other details described herein can vary considerably without departing from the basic principles of the invention. In addition, it should be appreciated that structural features or method steps shown or described in any one embodiment herein can be used in other embodiments as well.

What is claimed is:

1. A computer-implemented method for estimating fluid distribution in a subterranean reservoir comprising:

a. determining a macroporosity water saturation from capillary pressure data representative of a macroporosity;

b. correcting an entry pore value of capillary pressure data representative of a microporosity;

c. determining a microporosity water saturation from the corrected capillary pressure data representative of the microporosity; and d. using the macroporosity water saturation and the microporosity water saturation to estimate a fluid distribution within the subterranean reservoir, wherein at least one of (a) through (d) is executed on a computer.

2. The method of claim 1, wherein the entry pore value of the capillary pressure data representative of the microporosity is set to a pore throat size defining the microporosity.

3. The method of claim 1, further comprising estimating hydrocarbon reserves from the fluid distribution.

4. The method of claim 1, further comprising analysis of capillary pressure data to determine a threshold dividing the capillary pressure data representative of the microporosity and the capillary pressure data representative of the macroporosity.

5. The method of claim 1, wherein the capillary pressure data is from an air-brine centrifuge method.

6. The method of claim 1, wherein the capillary pressure data is from a Mercury Capillary Pressure Injection.

7. The method of claim 6, wherein the capillary pressure data from the Mercury Capillary Pressure Injection is transformed to simulate capillary pressure data from the air-brine centrifuge method.

8. The method of claim 1, wherein the macroporosity water saturation is calculated using a saturation height function.

9. The method of claim 8, wherein the saturation height function is a Leverett J-function.

10. The method of claim 1, wherein the microporosity water saturation is calculated using a saturation height function.

11. The method of claim 10, wherein the saturation height function is a Leverett J-function.

12. A system for estimating fluid distribution in a subterranean reservoir comprising:

a. a data source containing capillary pressure data;

b. at least one computer processor being configured to communicate with the data source and to execute computer program modules, the computer modules comprising:

an input module to receive the capillary pressure data from the data source;

a correction module to correct the capillary pressure data representative of a microporosity;

a water saturation module to calculate a water saturation for macroporosity and a water saturation for the microporosity; and a fluid distribution module to estimate a fluid distribution in the subterranean reservoir.

13. The system of claim 12, wherein the correction module sets the entry pore value of the capillary pressure data representative of the microporosity to a pore throat size defining the microporosity.

14. The system of claim 12, further comprising an output module to store or display at least one of the corrected capillary data, the water saturation for the macroporosity, the water saturation for the microporosity, and/or the fluid distribution.

15. The system of claim 12, further comprising a user interface device to allow interaction with the computer program modules and/or observe results of the computer program modules.

16. The system of claim 12, further comprising a hydrocarbon reserves module for estimating hydrocarbon reserves from the fluid distribution.

17. The system of claim 12, further comprising a thresholding module to graph the capillary pressure data and determine a threshold between the capillary pressure data representative of the microporosity and the capillary pressure data representative of the macroporosity.

18. An article of manufacture comprising a non-transitory computer readable medium having a computer readable code embodied therein, the computer readable program code adapted to be executed to implement a method for estimating fluid distribution in a subterranean reservoir, the method comprising:

a. determining a macroporosity water saturation from capillary pressure data representative of a macroporosity;

b. correcting an entry pore value of capillary pressure data representative of a microporosity;

c. determining a microporosity water saturation from the corrected capillary pressure data representative of the microporosity; and d. using the macroporosity water saturation and the microporosity water saturation to estimate a fluid distribution within the subterranean reservoir.

19. The method of claim 18, wherein the correcting the entry value of the capillary pressure data representative of the microporosity sets the entry pore value to the pore throat size defining microporosity.

20. The method of claim 18, further comprising estimating hydrocarbon reserves from the fluid distribution.

21. The method of claim 18, further comprising setting a threshold dividing the capillary pressure data representative of the microporosity and the capillary pressure data representative of the macroporosity.

* * * * *